US005508115A

United States Patent [19]

Linsey et al.

[11] Patent Number: 5,508,115

[45] Date of Patent: Apr. 16, 1996

[54] DUCTILE TITANIUM ALLOY MATRIX FIBER REINFORCED COMPOSITES

[75] Inventors: Gary D. Linsey, Glastonbury, Conn.; Otis X. Chen, Singapore, Singapore; Martin J. Blackburn, Kensington, Conn.

[73] Assignee: United Technologies Corporation, Hartford, Conn.

[21] Appl. No.: 41,087

[22] Filed: Apr. 1, 1993

[51] Int. Cl.[6] ..... B22F 7/04

[52] U.S. Cl. ..... 428/549; 428/551; 428/552; 428/553

[58] Field of Search ..... 75/246, 175.5; 148/11.5 F; 228/120; 420/418; 428/545, 614, 549, 551, 552, 553

[56] References Cited

U.S. PATENT DOCUMENTS

| | | | |
|---|---|---|---|
| 4,292,077 | 9/1981 | Blackburn et al. | 75/175.5 |
| 4,469,757 | 9/1984 | Ghosh et al. | 428/614 |
| 4,499,156 | 2/1985 | Smith et al. | 428/614 |
| 4,716,020 | 12/1987 | Blackburn et al. | 420/418 |
| 4,746,374 | 5/1988 | Froes et al. | 148/11.5 |
| 4,786,566 | 11/1988 | Siemers | 428/568 |
| 4,807,798 | 2/1989 | Eylon et al. | 228/190 |
| 4,816,347 | 3/1989 | Rosenthal et al. | 428/615 |
| 4,847,044 | 7/1989 | Ghosh | 419/8 |
| 4,896,815 | 1/1990 | Rosenthal et al. | 228/120 |
| 4,900,599 | 2/1990 | Doble | 423/65 |
| 4,927,458 | 5/1990 | Blackburn et al. | 75/246 |
| 5,104,460 | 4/1992 | Smith, Jr. et al. | 148/11.5 F |

*Primary Examiner*—Donald P. Walsh
*Assistant Examiner*—John N. Greaves
*Attorney, Agent, or Firm*—Robert J. Parizek

[57] ABSTRACT

A titanium alloy matrix fiber reinforced composite made from titanium alloy sheet processed to have ductility up to about 35%. Of particular usefulness is the composite having a $Ti_3Al$ titanium aluminide having this level of ductility. The composites have good resistance to thermal cyclic fatigue.

7 Claims, No Drawings

DUCTILE TITANIUM ALLOY MATRIX FIBER REINFORCED COMPOSITES

TECHNICAL FIELD

This invention relates to a fiber reinforced composite material with a titanium alloy-based matrix, and more particularly to a titanium aluminide intermetallic compound-based matrix fiber reinforced composite or titanium alloy matrix fiber reinforced composite material wherein the matrix material has good ductility at room temperature.

BACKGROUND ART

The uses of materials in aircraft gas turbine engines have become increasingly demanding in recent years. The requirements of increased performance and decreased fuel consumption place a premium on high strength and light weight. Improved performance generally relates to increases in operating temperature, so that material strengths must be retained at higher temperatures than previously encountered.

Titanium alloys generally provide high strength with light weight, although their useful strength is limited to approximately 1000° F., and special precautions must generally be taken to prevent oxidation. Titanium aluminides, generally of the TiAl or $Ti_3Al$ type, retain useful properties up to about 1500° F., but their usefulness is limited because their low temperature ductility greatly limits the fabrication techniques which may be used, and makes them highly susceptible to matrix cracking due to mechanical damage incurred during normal handling and usage at ambient temperature.

It is well known to increase the strength of structural materials by embedding high strength fibers in a matrix material to form composite materials. While these composite materials generally benefit by combining the best properties of the component materials, such as the high strength of the reinforcing fibers, they can also be limited by other properties of the materials.

Titanium alloy fiber reinforced composites have improved strengths, but are still limited by the high temperature strength and low oxidation resistance above 1000° F. Titanium aluminide matrix fiber reinforced composites also have improved strength, with the improvements being retained up to 1500° F. Fabricability of the titanium aluminide fiber reinforced composites is very limited because of the low room temperature ductility of the titanium aluminide.

In U.S. Pat. No. 4,816,347, to Rosenthal, et al., this limitation of low room temperature ductility was overcome by interposing layers of a titanium alloy having good ductility, positioned to surround the high strength reinforcing fibers, between sheets of titanium aluminide, thus providing a hybrid titanium metal matrix composite having good strengths at temperatures up to about 1500° F. and good room temperature mechanical properties including good ductility and improved resistance to matrix cracking.

The improved high temperature strength of a titanium aluminide matrix fiber reinforced composite material is generally accompanied by limited fabricability due to low room temperature ductility. Rosenthal, et al., were able to resolve this problem only by the addition of a lower strength titanium alloy material, thus forming a hybrid composite. The addition of the lower strength material, however, results in a reduction in the overall capabilities of the composite.

Siemers, in U.S. Pat. No. 4,786,566, disclosed a method for formation of a fiber reinforced trititanium aluminide matrix composite which involves plasma spraying of the matrix material onto an array of aligned fibers to form a fiber reinforced sheet. The sheets are then laid up and bonded together to form a fiber reinforced object. Siemers reported that the composites had good strength, but that the ductility was somewhat limited. This technique avoids the difficulties associated with trying to form thin sheets of the low ductility titanium aluminide material, but does not provide composites which are particularly usable.

Composites made without the ductile matrix suffer performance deficits during such tests as thermal fatigue cycling, where the component is exposed to temperatures ranging, generally, from room temperature to an elevated service temperature. Large stresses are generated in the boundary region at the interface between the fibers and the matrix, due to the large mismatch in the thermal expansion coefficients of the reinforcing fibers ($2.7\times10^{-6}$/°F. for SCS-6 silicon carbide fibers, a product of Textron Specialty Metals/Subsidiary of Textron, Inc.) and the matrix material ($5.7\times10^{-6}$/°F. for $Ti_3Al$. These stresses frequently cause cracking in the matrix, and/or disbonding of the reinforcing fibers from the matrix, which leads directly to failure of the composite.

Thus, what is needed is a material which achieves the good high temperature strength properties of a titanium aluminide matrix fiber reinforced composite material while retaining good low temperature ductility.

DISCLOSURE OF THE INVENTION

This invention provides a fiber reinforced composite material wherein the matrix material, either titanium alloys or titanium aluminide-based intermetallic compounds, has improved ductility at room temperature compared to conventionally processed matrix materials. A unique processing technique, involving thermomechanical processing which includes multiple working steps below the beta transus with intervening thermal annealing steps, also at temperatures below the beta transus, provides matrix materials having reduced elastic modulus and ductilities up to about 45%.

Fiber reinforced composites based on these improved matrix materials can be formed at temperatures lower than the temperatures conventionally used for titanium matrix composite formation, which reduces the formation of oxides and other undesirable brittle compounds at the fiber-matrix interface. The resulting composites experience a significant reduction in the amount of matrix cracks generated in the matrix and at the fiber-matrix interface during thermal cycling tests.

These, and other features and advantages of the invention, will be apparent from the description below, read in conjunction with the drawings.

BEST MODE FOR CARRYING OUT THE INVENTION

The invention process involves the formation of a fiber reinforced composite material having a matrix of either $Ti_3Al$ or a titanium alloy, with the matrix material being processed to provide enhanced ductility and reduced elastic modulus.

The high ductility, low modulus $Ti_3Al$ base matrix material is obtained by subjecting the material to a series of hot rolling steps at temperatures below the beta transus temperature for the particular alloy, which is typically about 2000° F. for most titanium alloys. In hot working, especially rolling, the material cools during processing. The hot rolling in the invention process is initiated at about 1600°–1800° F., and proceeds until the material cools to about 1100°–1400° F., at which point the material is reheated and rolled further. At the completion of rolling, a 1–10 hour anneal at about 1600°–1900° F. is preferred. In this manner, very thin sheets, on the order of 0.020" thick, can be produced having room temperature ductilities of at least 10%, and in many cases up to as high as 45%. The material also has a reduced elastic modulus compared to conventionally processed material. This material may then be cold rolled to further reduce the thickness, and intermediate sub-beta transus anneals may be employed to relieve the residual stresses built up during the cold rolling.

As previously described the application process utilizes alpha-two titanium materials and preferably those whose compositions are set forth in TABLE I. These materials are processed at temperatures below the beta-transus temperature (typically about 2,000° F.), and more specifically are processed by hot working at starting temperatures of 1,600° F. to 1,900° F. (preferably 1,600° F.). In hot working, especially rolling, the material usually cools during processing. The hot rolling in the invention starts at 1,600° F. to 1,900° F. and proceeds until the material cools to 1,400° F. to 1,100° F. and the material is then reheated and rolled further. At the completion of rolling, a one to ten hour anneal at 1,600° F. to 1.900° F. is preferred. TABLE II shows exemplary properties of alloys as in TABLE I with conventional processing and with the processing claimed in U.S. Ser. No. 07/239,484. (The processing used to produce the starting materials for the present invention and which is incorporated herein by reference.)

In the case of production of sheet material, the starting alloy may be provided as ingot material or in the form of a metal powder compact. Metal powder compaction is conventional and can be by extrusion or hot isostatic pressing.

The starting material may have an exemplary thicknesses of 1 inch to 4 inches and a typical beta transus of 2,000° F. This material is heated to 1,750° F. and rolled in a rolling mill to produce 10% to 15% reduction per pass (this is the processing value which we used but other values are possible including increased reduction amounts, but insufficient to cause cracking). After three to six passes, when the temperature of the material has dropped to typically 1,300° F., the material is reheated to the starting temperature of 1,750° F. and held at this temperature for a time of 5 minutes to 15 minutes for an intermediate anneal. The annealing temperature may be different from the rolling temperature. When this rolling and reheating sequence has been repeated several times and the material thickness has been reduced to 0.020 inches to 0.100 inches the material will be given a final anneal. The final annealling temperature will range from 1,500° F. to 1,900° F. (preferably 1,600° F. to 1,800° F.) for times of at least 30 minutes and preferably one hour to ten hours. From this point, cold rolling can be used to further reduce the material thickness and intermediate sub-beta transus anneals may be employed.

It has been found that the tensile ductility is anisotropic and that the maximum ductility is displayed in the rolling direction. Sheet material rolled in a single direction displays 35% ductility in the rolling direction and 10% ductility in the transverse direction. If more isotropic properties are desired, the material can be cross rolled in order to produce ductilities in excess of 25% in both the rolling direction and the transverse direction. Useful ductility improvements appears to require at least about a 60% reduction in area (sheet thickness in the case of rolling) and preferably at least 90%.

We believe that at least three hot work plus anneal cycles are required and preferably at least five such cycles.

TABLE I

| | Broad | Int | Preferably |
|---|---|---|---|
| Al | 12.0–22.0 | 13.0–20.0 | 13.0–20.0 |
| Nb | 10.0–33.0 | 20.0–30.0 | 18.0–30.0 |
| Mo | 0.0–6.0 | 0.0–3.0 | 0.5–3.0 |
| V | 0.0–6.0 | 0.0–4.0 | 0.0–4.0 |
| Ta | 0.0–6.0 | 0.0–3.0 | — |
| (Mo + V + Ta + Cr + W) | 0.0–8.0 | 0.0–5.0 | 0.0–5.0 |
| Cr | 0.0–4.0 | 0.0–3.0 | — |
| W | 0.0–4.0 | 0.0–3.0 | — |
| Si | 0.0–1.0 | 0.0–0.5 | — |
| (Mo + Cr + W) | 0.0–5.0 | 0.0–4.0 | — |
| Fe | <0.10 | — | — |
| C | <0.05 | — | — |
| O | <0.10 | — | — |
| H | <150.00 ppm | — | — |
| Ti | Balance | — | — |

TABLE II

| | Conventional | Invention |
|---|---|---|
| Ductility | 2% to 3% | 30% to 40% |
| Yield Strength | 100 ksi to 120 ksi | 60 ksi to 100 ksi |
| Ultimate Tensile Strength | 110 ksi to 130 ksi | 110 ksi to 150 ksi |

Similar thermomechanical processing as was applied to the $Ti_3Al$ intermetallic compound material can also be applied to other titanium alloys with similar increases in ductility, both at room temperature and at elevated temperatures, while basically retaining the other significant mechanical properties.

A composite is formed by positioning reinforcing fibers, arrayed in a manner suitable for the intended application, between sheets of the matrix material. The desired composite structure is achieved by assembling a series of properly oriented layers of the fibers between matrix material sheets until the desired thickness and configuration are achieved.

The assembly is then compacted under conditions of applied pressure at elevated temperature, allowing the sheets of matrix material to deform and surround the reinforcing fibers, followed by diffusion bonding of the individual sheets of the matrix material to form a continuous matrix around the reinforcing fibers.

In this manner, a composite is formed which combines the strength properties of the reinforcing fibers with the enhanced ductility of the matrix material. The mechanical properties of the composite material are adequately predicted by the Rule of Mixtures, which is commonly applicable to composite materials.

Thus titanium alloy matrix fiber reinforced composite materials can be formed at lower temperatures using these enhanced ductility materials, which reduces the susceptibility of the materials to undesirable high temperature effects, such as brittle compound formation at the fiber-matrix interface, during consolidation of the matrix around the fibers.

The principles of the present invention may be better understood through reference to the following illustrative examples.

EXAMPLE 1

High ductility, low modulus alpha-two (Ti-14Al-23Nb-2.2V) foil was prepared using the rolling techniques described in patent application Ser. No. 07/239,484, referred to above. A single layer of SCS-6 silicon carbide reinforcing fibers (a product of Textron Specialty Metals, a subsidiary of Textron, Inc.) was then laid up so that the fibers were parallel to each other and uniformly spaced approximately one fiber diameter from each other. A layer of the ductile foil was then laid over the layer of fibers. In a similar manner additional alternating layers of fibers and foil were laid up until the desired thickness of eight layers was achieved. This composite had about 30% by volume of fiber in the matrix, although we believe, based on our experience with other similar composite materials, that this invention will work as well with fiber volumes up to about 40%.

This fiber-foil assembly was then placed in a vacuum hot press, and the assembly was subjected to a pressure of 5 ksi at a temperature of 1750° F. for a period of 10 minutes, 10 ksi at 1750° F. for 10 minutes, and 15 ksi at 1750° F. for 160 minutes. The composite produced in this manner had a strength of 230 ksi and a modulus of elasticity of 30,000,000 psi, which is as predicted by the Rule of Mixtures.

Metallographic examination of the composite revealed full consolidation without chemical reaction between the fibers and the matrix material. Adequate thermal fatigue resistance was demonstrated by exposing the composite to 100 cycles between room temperature and 1500° F., after which no longitudinal or transverse cracking in the matrix material between the fibers was observed metallographically.

EXAMPLE 2

Ductilized alpha-two (Ti-14Al-21Nb) foil was prepared using the same rolling techniques as in Example 1. A single layer of SCS-6 silicon carbide reinforcing fibers was then laid up so that the fibers were parallel to each other and uniformly spaced approximately one fiber diameter from each other. A layer of the ductile foil was then laid over the layer of fibers. Again additional alternating layers of fibers and foil were laid up until the desired thickness of eight layers was achieved. About 30% by volume of fiber in the matrix was achieved.

This fiber-foil assembly was then placed in a vacuum hot press, and the assembly was subjected to a pressure of 5 ksi at a temperature of 1800° F. for a period of 10 minutes, 10 ksi at 1800° F. for 10 minutes, and 15 ksi at 1800° F. for 160 minutes. The composite produced in this manner also had a strength of 230 ksi and a modulus of elasticity of 30,000,000 psi.

Metallographic examination of the composite revealed full consolidation without chemical reaction between the fibers and the matrix material. Adequate thermal fatigue resistance was demonstrated by exposing the composite to 100 cycles between room temperature and 1500° F., after which no longitudinal or transverse cracking in the matrix material between the fibers was observed metallographically.

A similar composite, prepared of Ti-14Al-21Nb and SCS-6 fibers, but using the plasma spray technique for forming the matrix material around the reinforcing fibers described in Siemers, experienced both longitudinal and transverse cracking of the matrix material, as determined metallographically.

Although this invention has been shown and described with respect to detailed embodiments thereof, it will be understood by those skilled in the art that various changes in form and detail thereof may be made without departing from the spirit and scope of the claimed invention.

We claim:

1. A titanium alloy matrix fiber reinforced composite material comprising at least one layer of high strength reinforcing fibers embedded in a matrix of $Ti_3Al$ material, said matrix material having at least 10% room temperature ductility and improved resistance to thermal cyclic fatigue.

2. A composite material as recited in claim 1 wherein said matrix material has at least 20% room temperature ductility.

3. A composite material as recited in claim 1 wherein said matrix material has at least 35% room temperature ductility.

4. A composite material as recited in claim 1 wherein said reinforcing fibers are of silicon carbide.

5. A composite material as recited in claim 1 wherein the volume of reinforcing fibers in the composite is a maximum of about 40%.

6. A composite material as recited in claim 1 wherein the volume of reinforcing fibers in the composite is about 30%.

7. A composite material as recited in claim 1 wherein the titanium alloy is of the $Ti_3Al$ titanium aluminide type.

* * * * *